United States Patent [19]

Mazur

[11] 4,225,868

[45] Sep. 30, 1980

[54] LOW-PROFILE X-Y ANTENNA PEDESTAL UTILIZING MULTI-HINGE POINTS TO PROVIDE ANGULAR MOTION FOR EACH AXIS

[75] Inventor: John T. Mazur, Sebastian, Fla.

[73] Assignee: Harris Corporation, Cleveland, Ohio

[21] Appl. No.: 892,201

[22] Filed: Mar. 31, 1978

[51] Int. Cl.[2] ..... H01Q 3/03

[52] U.S. Cl. ..... 343/765; 248/396

[58] Field of Search ..... 343/765, 766, 888, 763, 343/882; 248/396

[56] References Cited

U.S. PATENT DOCUMENTS

| | | | |
|---|---|---|---|
| 3,215,391 | 11/1965 | Storm | 343/765 |
| 3,263,232 | 7/1966 | Burwell et al. | 343/765 |
| 3,374,977 | 3/1968 | Moy | 343/765 |

*Primary Examiner*—Eli Lieberman

*Attorney, Agent, or Firm*—Craig & Antonelli

[57] ABSTRACT

An antenna pedestal for producing angular motion is formed of a base and upper and lower subassemblies. Pivot arrangements are provided between the base and the lower subassembly for enabling the lower subassembly to be angularly displaced with respect to the base about a pair of parallel axes by a pair of linear actuators which are connected between the base and the lower subassembly. The first of these actuators rotates the lower pedestal through a first arc sector and the other rotates the lower subassembly in a second arc sector which is in a common plane with the first arc sector. Likewise, the upper subassembly is supported on the lower subassembly with pivot arrangements located therebetween for enabling the upper subassembly to be angularly displaced with respect to the lower subassembly about a further pair of parallel axes which are orthogonal with the pair of axes about which the lower subassembly is displaced relative to the base. Further linear actuators are connected between the upper and lower subassemblies for providing the displacement of the upper subassembly through third and fourth sector, respectively, in a plane which is orthogonal with respect to the plane of the first and second arc sectors.

14 Claims, 3 Drawing Figures

LOW-PROFILE X-Y ANTENNA PEDESTAL UTILIZING MULTI-HINGE POINTS TO PROVIDE ANGULAR MOTION FOR EACH AXIS

BACKGROUND AND SUMMARY OF THE INVENTION

The present invention relates to pedestals for providing angular motion, and in particular to pedestals for antennas. Still more specifically, the present invention relates to antenna pedestals for providing X-Y antenna displacements.

X-Y antennas are well known and are valuable for many applications. However, typical X-Y pedestals have a very high profile, large sweep volume, and limited sky coverage. These characteristics of the prior art X-Y pedestals have limited the applicability of X-Y axis pedestal antennas.

For example, prior art X-Y antennas are caused to rotate about a single X axis pivot and a single Y axis pivot such that, if simple linear actuators are to be used to produce rotative movement, the resultant geometric configurations are necessarily of a high profile and the antenna must sweep a relatively large volume, while the positioning of the X and Y axis with respect to its associated actuators limits sky coverage to sweeps of 90° in either direction with respect to the X and Y axes.

Accordingly, it is an object of the present invention to provide an X-Y antenna pedestal for providing angular motion that permits extended sky coverage.

It is also an object of this invention to avoid the above-noted disadvantages by providing an X-Y axis pedestal which enables a low profile to be obtained with respect to each of the axes.

It is a still further object of the present invention to achieve all of the above-noted objects in a pedestal construction which is driven by simple actuators and wherein the structural configuration is such that fabrication costs are lowered, and the pedestal can be easily assembled on site from a few compact units.

The above and other objects of the invention are achieved according to a preferred embodiment of the present invention by constructing the pedestal of a base, lower subassembly and upper subassembly.

To provide angular displacement with respect to the base, a pair of parallel rotational axes are positioned between the base and the lower subassembly, and a pair of linear actuators are connected between the base and the lower subassembly for angularly displacing the subassembly about the pair of parallel axes through two separate arc sectors which are located in a common plane so as to enable an antenna mounted upon the pedestal to be swept through arcs of, for example, ±125°.

Additionaly, the upper subassembly is mounted so as to be angularly displaceable with respect to the lower subassembly by the provision of a second pair of parallel axes between the upper and lower subassemblies, this further pair of axes being oriented in an orthogonal manner with respect to the axes located between the base and lower subassembly, such that if the first pair of axes serve as the X-axis, the second set of axes between the upper and lower subassemblies will serve as the Y-axis. In a preferred embodiment the linear actuators for angularly displacing the upper and lower subassemblies are constructed in a simple manner, for example, through the use of a pair of linear actuators, such as fluid driven piston-cylinder units arranged diagonally for driving a respective pedestal about a respective axis.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
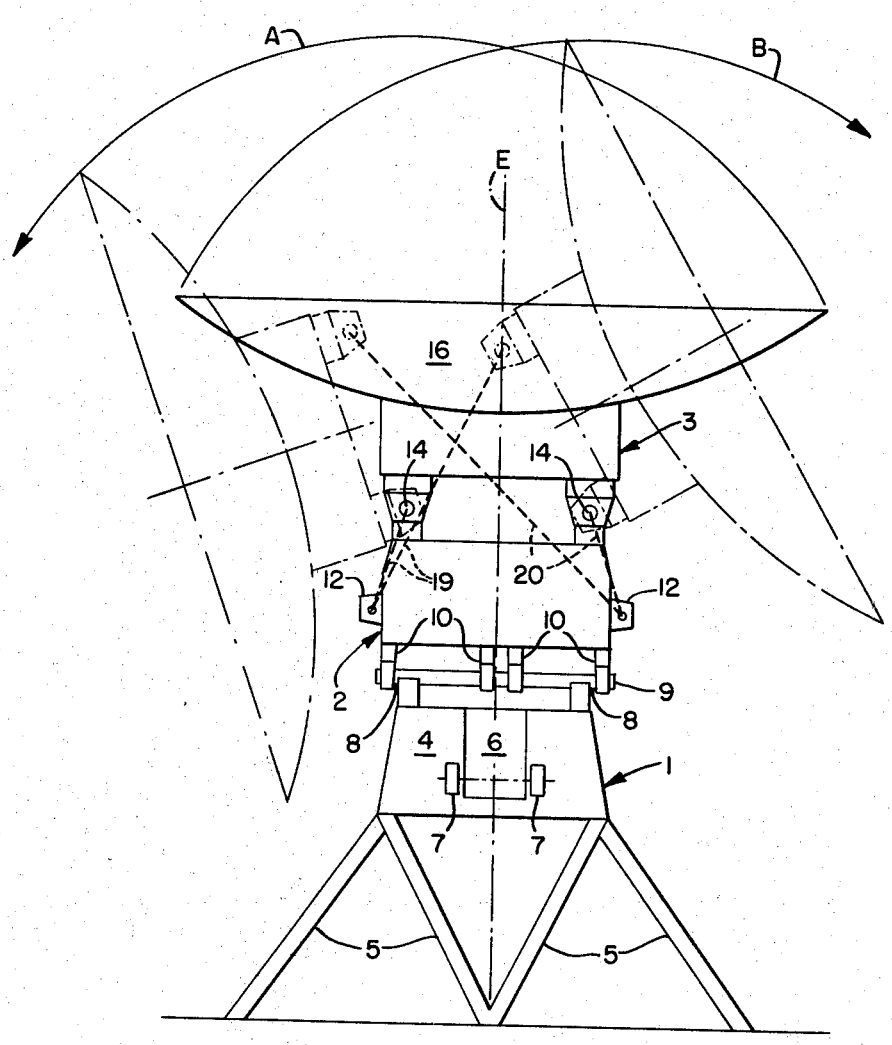
FIG. 1 is a vertical elevational view illustrating a preferred embodiment of a pedestal according to the present invention viewed along the Y-axis.

Referring now in greater detail to the figures of the drawings, FIG. 1 illustrates an antenna suitable for shipboard application incorporating the pedestal according to the present invention. The preferred embodiment illustrated is readily transportable inasmuch as the pedestal is composed of three small compact units which are readily bolted together without the need for precision alignment and to which an antenna can be easily connected. More specifically, the pedestal is formed of a base 1, a lower subassembly 2, and an upper subassembly 3.

The base 1 can be formed advantageously by a supporting platform 4 carried by legs 5. The supporting platform 4 is further provided with a linear actuator receiving recess 6 and pivot support blocks 7 In this regard, it is noted that since the linear actuators per se form no part of the present invention and since any number of conventional linear actuators can be utilized for providing the desired angular displacement, the linear actuators (which will be discussed in greater detail below) are merely illustrated in FIGS. 1 and 2 in a schematic manner by dashed lines.

For providing relative angular movement between the lower subassembly 2 and the base 1, the base is provided with pillow block bearings which receive X-axis shafts 9 which are journaled in supports 10 mounted on the underside of lower subassembly 2.

In a pedestal arrangement as in the preferred embodiment, wherein Y-axis arcuate movement is to be achieved in a similar manner to that achieved about the X-axis, the lower subassembly is formed with linear actuator receiving recesses 11 and pivot supports 12, while its upper surface is provided with pillow block bearings 13. These pillow block bearings 13 receive the X-axis forming pivot shafts 14 which are journaled in the bearing mounts 15 which are located on the lower side of the upper subassembly 3 which carries the antenna 16.

As previously noted, the base 1 is provided with recesses 6 and pivot supports 7 for schematically illustrated actuators 17 and 18. These linear actuators 17, 18 are pivotally connected at one end to the supports 7 and are free to move within the recesses 6 through which they extend to a pivotable point of attachment at approximately the midpoints of the X-axis forming shafts 9 which are supported against bending by the two centrally located bearing blocks 10. Similarly, the linear actuators 19 and 20 are pivotally mounted at one end to the supports 12 and extend through the recesses 11 to a pivotable point of attachment at approximately the midpoints of Y-axis forming shafts 14 which are also braced in their central area by the bearing supports 15 to minimize bending of these shafts.

Thus, each of the subassemblies is mounted with multiple hinge points formed by the pillow-bearing blocks and axis-forming shafts 8, 9 and 13, 14, respectively, such that by extension of the respective linear actuators 17–20, an appropriate displacement of an antenna carried by the pedestal can be achieved through the respective arc sectors A–D of approximately ±125° with respect to the central vertical axis E to provide a total sweep of 250° thereabout (and four angularly displaced positions are illustrated in outline form in the drawings).

Figure 3:
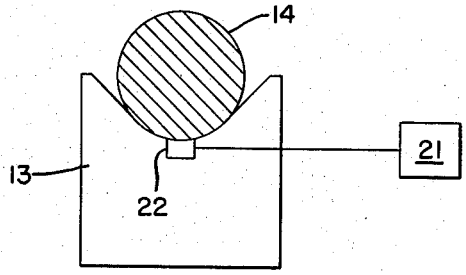
FIG. 3 is a section taken along line A—A of FIG. 2 and shows a pillow block bearing and a schematic representation of the changeover control.

It is noted that the linear actuators are formed of fluid operated piston-cylinder units according to a preferred embodiment of the present invention, and while the fluid drive circuit for controlling these actuators is not illustrated in the drawings, the manner by which such piston-cylinder units can be driven and coordinated will be obvious to those of ordinary skill in the art, such that no detailed description thereof is believed necessary. However, it is noted that when the V-shaped bearing blocks 13 are utilized to form decouplable hinge points such as shown in FIG. 3, the actuators are preloaded in order to hold the shafts snuggly in the V-shaped blocks so as to provide a load path at these joints.

Additionally, in order to provide a smooth, continuous transition in sweeping, for example, from arc sector A to arc sector B, the control 21 for the linear actuators 17–20 includes a change-over control for handing over power from one actuator to the other. This change-over can advantageously be achieved by the control system 21 upon actuation of micro-switches 22 upon engagement of a respective shaft 9, 14 with its associated V-shaped block 8, 13.

In view of the foregoing description of the preferred embodiment of the present invention, the following manner of assembly and operation will now be apparent to those of ordinary skill in the art.

In view of the fact that the pedestal according to the present invention is formed of small, compact units which are simply assembled together without the need for precision alignment, the pedestal can be transported as separate subassemblies and assembled where the antenna installation is to be located. This assembly can be quickly and easily achieved by first erecting the legs 5 so as to support the base 1 and then resting the lower subassembly 2 with the shafts 9 located within the V notches of the blocks 8. The linear actuators 17 and 18 can then be connected at one end to the pivot blocks 7 and at the other end about the shafts 9 between the two centralmost support bearings 10 by simple conventional couplings that are readily bolted together.

After the lower subassembly is mounted and connected, the upper subassembly 3 and actuators 19, 20 can be assembled and connected to the lower subassembly 2 in the same manner as noted with respect to the assembly and mounting of the lower subassembly 2 to the base 1. The antenna 16 (or other such structure to be carried by the pedestal) can then be bolted to the upper subassembly 3. However, if desired, the antenna 16 can be initially fabricated as a unit with the upper subassembly 3 where the size of the antenna makes such practical, thereby eliminating this last step.

After the above-noted assembly of the antenna pedestal, the drive control unit and associated interconnections with the linear actuators 17–20 and change-over control micro-switches 22 can be effectuated.

To obtain Y-axis rotation in the left arc sector in the direction of the arrow A (FIG. 1) the control 21 is actuated to extend linear actuator 20, while linear actuator 19 holds the left-hand Y-axis forming shaft 14 snuggly in its V-blocks so as to achieve rotation of the upper subassembly 3 and the antenna carried thereby to a position such as is illustrated by the left-hand outline form. To then obtain Y-axis rotation in the right sector in the direction of arrow B (FIG. 1) the control 21 causes a retraction of actuator 21 towards the central axis E and upon the right-hand Y-axis forming shaft 14 contacting its respective V-block 13, micro-switch 22 is triggered so as to bring about a change-over of power from actuator 20 to actuator 19 such that actuator 20 now exerts a preload force in order to hold the right-hand shaft 14 within its V-block 13 so as to form an axis of rotation for the upper subassembly which is caused to be rotated under action of the now extending actuator 19.

Figure 2:
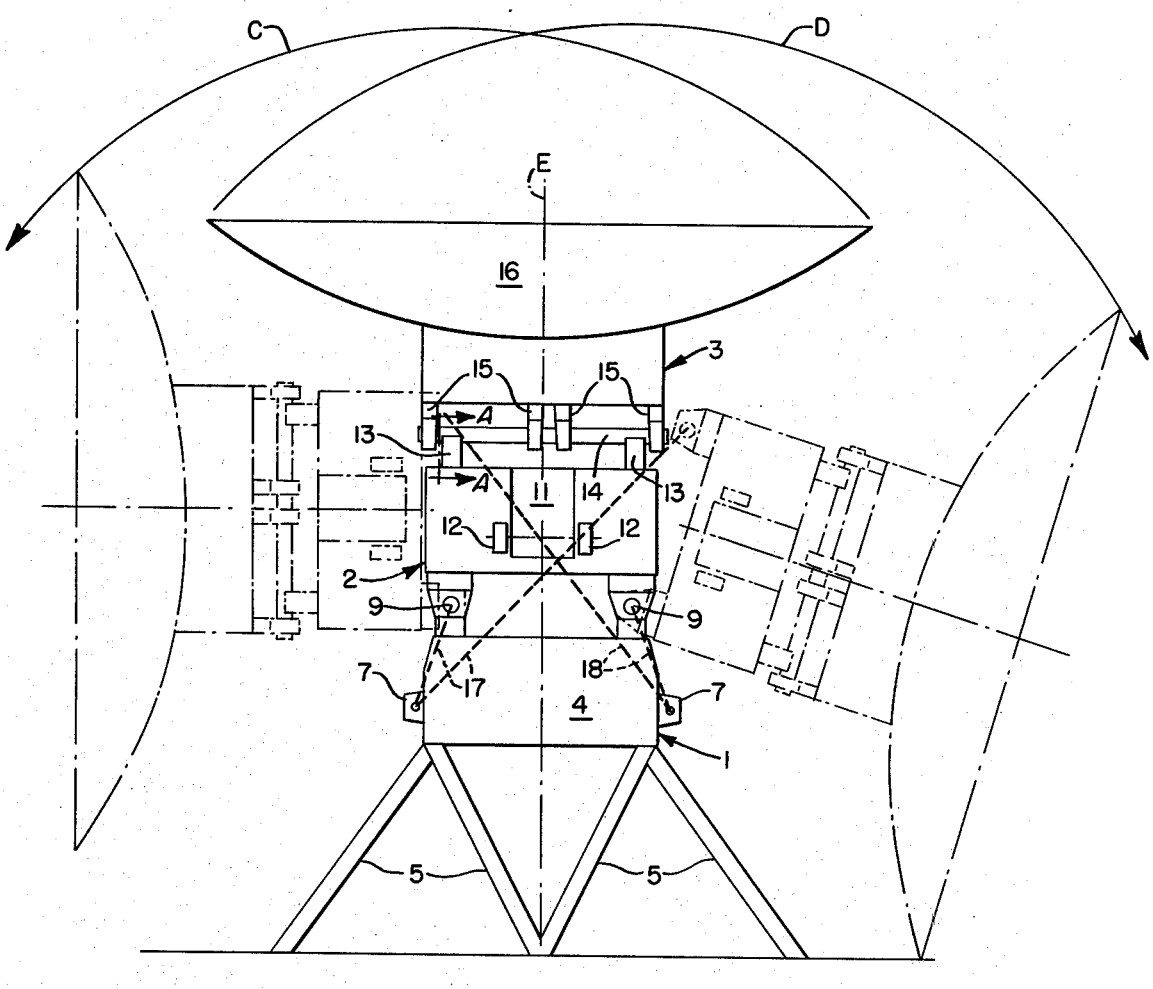
FIG. 2 is a side elevational view of the preferred embodiment according to FIG. 1, but viewed along the X-axis.

Similarly, X-axis rotation is achieved by the extension of actuator 18 displacing the lower subassembly in the direction of arrow C through a first arc sector toward a position such as shown in the left-hand side of FIG. 2 while the preloaded actuator 17 holds the left-hand X-axis forming shaft 9 within its associated V-blocks 8, and a sweeping in a right sector in the direction of the arrow D is achieved by extension of the actuator 17 while the actuator 18 holds the right-hand X-axis forming shaft snuggly received in the right-hand V-blocks. Likewise, a change-over of power between the actuators 17 and 18 is facilitated as the lower subassembly reaches the central axis E by engagement of a respective X-axis forming shaft 9 against a microswitch 22 upon seating of the shaft in a respective V-block 8, which occurs in the same manner described with respect to FIG. 3 and Y-axis movement.

Furthermore, it is noted that while angular movement of the subassemblies with respect to either the X or Y axis has been described, compound X-Y motion can be achieved by suitably coordinating the movements of both the actuators 17 or 18 with the movement of actuators 19 or 20 can be achieved so as to enable an antenna mounted upon the pedestal to sweep arcs which are large in comparison to prior art XY antennas (for example, ±125°) in any direction with respect to the central axis E. This capability for low profile and large sky coverage allows the application of X-Y antennas in a much wider range of systems than has been previously possible, such as in shipboard applications.

In summary, the present invention provides an antenna pedestal of improved construction which, due to its structural configuration, is a very efficient space frame which results in lower fabrication costs and may be transportable as subassemblies which can be readily assembled together, without the need for alignment, at the utilizing location, while increasing significantly the area of applicability of X-Y antennas due to the low profile, low swept volume, and large axis of motion for increased sky coverage. Furthermore, these advantages are achievable while still enabling the axes to be driven by simple actuators which, while preferably hydraulic or pneumatic piston-cylinder units, can be any suitable linear actuator connected and operated in the manner disclosed.

While I have shown and described a preferred embodiment in accordance with the present invention, it is understood that the same is not limited thereto, but is susceptible to numerous changes and modifications as known to those of ordinary skill in the art. For example, while V-block pillow bearings have been disclosed for forming the arcuate axes, other equivalent bearing arrangements could be provided, and while the pedestal arrangement according to the preferred embodiment utilizes the multi-hinge point arrangement according to the present invention for providing motion about both the X and Y axes to form an X-Y axis antenna, it is within the scope of the present invention to mount the base upon a turret rotatable about a vertical axis with an antenna carried upon the lower subassembly so as to form an elevation-azimuth type antenna. Accordingly, I therefore do not wish to be limited to the details shown and described herein, but intend to cover all such changes and modifications as are encompassed by the scope of the appended claims.

I claim:

1. An antenna pedestal for providing angular motion comprising:

a base, a subassembly supported on said base, pivot means between said base and said subassembly for enabling said subassembly to be angularly disposed with respect to said base about a pair of parallel axes, first linear actuator means connected between said base and said subassembly for angularly displacing said subassembly about one of said pair of axes through a first arc sector, and second linear actuator means connected between said base and said subassembly for angularly displacing said subassembly about the other of said axes through a second arc sector in a common plane with the first arc sector, said first linear actuator means causing displacement of said subassembly in a direction opposite that caused by said second linear actuator means, wherein said subassembly is a lower subassembly and wherein the pedestal further comprises an upper subassembly supported on said lower subassembly, further pivot means between said lower and upper subassemblies for enabling said upper subassembly to be angularly displaced with respect to said lower subassembly about a further pair of parallel axes, said further axes being orthogonal with respect to the axes about which the lower subassembly is disposed relative to said base, third and fourth linear actuator means connected between said upper and lower subassemblies for displacing said upper subassembly about said further axes through third and fourth arc sectors, said third and fourth arc sectors being in a plane which is orthogonal with respect to the plane of the first and second arc sectors.

2. An antenna pedestal according to claim 1, wherein control means are provided for enabling said linear actuators to be operated so as to enable an antenna mounted upon said pedestal to sweep arcs of $\pm 125°$ in any direction about a central axis between said linear actuators.

3. An antenna pedestal according to claim 1, wherein said linear actuator means are fluid operated piston-cylinder units.

4. An antenna pedestal according to claim 2, wherein said pivot means and said further pivot means are formed by pillow block bearings and shafts engageable in notches formed therein.

5. An antenna pedestal according to claim 1, wherein said pivot means and said further pivot means are formed by pillow block bearings and shafts engageable in notches formed therein.

6. An antenna pedestal according to claim 1, further comprising change-over control means operatively associated with said linear actuator means for switching power between said first and second linear actuator means in order to provide substantially continuous movement of said lower subassembly between said first and second arc sectors and for switching power between said third and fourth linear actuator means in order to provide substantially continuous movement of said upper subassembly between said first and second arc sectors.

7. An antenna pedestal according to claim 6, wherein said change-over control means includes micro-switch means.

8. An antenna pedestal according to claim 4, further comprising change-over control means operatively associated with said linear actuator means for switching power between said first and second linear actuator means in order to provide substantially continuous movement of said lower subassembly between said first and second arc sectors and for switching power between said third and fourth linear actuator means in order to provide substantially continuous movement of said upper subassembly between said first and second arc sectors.

9. An antenna according to claim 8, wherein said change-over control includes micro-switch means positioned so as to be actuatable by engagement of a respective shaft with a respective one of the pillow block bearings.

10. An antenna pedestal for providing angular motion comprising:

a base, a subassembly supported on said base, pivot means between said base and said subassembly for enabling said subassembly to be angularly displaced with respect to said base about a pair of parallel axes, said pivot means including first and second pillow block bearing means and first and second journal means connected to one of said base and subassembly, respectively, said first and second pillow block bearing means having a journal receiving configuration for supportively receiving said first and second journal means, respectively, in a rest position, first linear actuator means connected between said base and said subassembly for disengaging said first journal means from said first pillow block bearing means and angularly displacing said subassembly through a first arc sector about one of said pair of axes formed by said second journal means within the journal receiving configuration of the second pillow block bearing means, and second linear actuator means connected between said base and said subassembly for disengaging said second journal means from said second pillow block bearing means and angularly displacing said subassembly about the other of said axes formed by said first journal means within the journal receiving configuration of the first pillow block means through a second arc sector in a common plane with the first arc sector, said first linear actuator means causing displacement of said subassembly in a direction opposite that caused by said second linear actuator means.

11. An antenna pedestal according to claim 10, wherein said first linear actuator means is pivotally connected at one end to the base and its opposite end to said subassembly on a first side of a central plane for rotating said subassembly about one of said pair of axes that is located on a second side of said central plane, and wherein the second linear actuator means is pivotally connected at one end to said subassembly at an opposite end to said base on said second side of the central plane for producing rotation of said subassembly about the other of said pair of axes that is located on said first side of said central plane.

12. An antenna pedestal according to claim 11, wherein said first and second linear actuator means are fluid operated piston-cylinder units.

13. An antenna pedestal according to claim 10, further comprising change-over control means operatively associated with said linear actuator means for switching power between said first and second linear actuator means in order to provide substantially continuous movement of said subassembly between said first and second arc sectors.

14. An antenna pedestal according to claim 13, wherein said change-over control means includes micro-switch means positioned so as to be actuatable by engagement of a shaft forming said journal means within a notch of a support block forming said journal receiving configuration.

* * * * *